US005346083A

United States Patent [19]

Song et al.

[11] Patent Number: 5,346,083

[45] Date of Patent: Sep. 13, 1994

[54] CONTAINER AND/OR CLOSURE THEREFOR

[75] Inventors: Pill-Soon Song; William R. Parker, Jr., both of Lincoln, Nebr.

[73] Assignee: The Board of Regents of The University of Nebraska, Lincoln, Nebr.

[21] Appl. No.: 173,280

[22] Filed: Dec. 27, 1993

Related U.S. Application Data

[63] Continuation of Ser. No. 892,248, Jun. 2, 1992, abandoned.

[51] Int. Cl.[5] ..... B65D 53/00

[52] U.S. Cl. ..... 215/341; 215/344; 215/354; 220/304

[58] Field of Search ..... 215/329, 341, 343, 344, 215/354; 220/288, 304

[56] References Cited

U.S. PATENT DOCUMENTS 2,529,964 11/1950 Raas ..... 215/329 X
3,360,149 12/1967 Roth ..... 215/344
3,881,627 5/1975 Davolt ..... 215/329

*Primary Examiner*—Allan N. Shoap
*Assistant Examiner*—Nova Stucker
*Attorney, Agent, or Firm*—Vincent L. Carney

[57] ABSTRACT

To permit a container and a cap to remate with each other during resealing without fouling by solid debris such as small particles without exceptional preparations to withstand the deteriorating effects of corrosive materials and solvents and to consistently and quickly form a gas-tight seal, the container has a flat angled surface and the cap has cooperating edge that engages the flat surface in a closed line when the cap is fully inserted with a solid closed surface within the line, the closed line having a width perpendicular to its length within a range of 0.5 millimeters to 1.5 millimeters. The cap is closed by screw threads or the like that force the cooperating surfaces together with a pressure of at least 100 psi at an angle of between 75 degrees and 105 degrees.

5 Claims, 2 Drawing Sheets

CONTAINER AND/OR CLOSURE THEREFOR

RIGHTS IN THE UNITED STATES GOVERNMENT

This invention was made with federal support under National Institutes of Health Grant GM36956. The United States Government has certain rights to the invention.

This application is a continuation of application Ser. No. 07/892,248, filed Jun. 2, 1992 abandoned.

BACKGROUND OF THE INVENTION

This invention relates to containers and/or closures therefor useful under adverse environments.

One class of containers includes a cap and a vessel body having walls and a bottom that are liquid or gas tight. The cap has either integrally formed or separate sealing means to form a liquid-tight or gas-tight enclosure with the vessel, the vessel and cap being formed of a material or materials capable of withstanding adverse environments, such as for example, acidic or basic environments with or without small particles. These containers are adapted to close tightly such as through the use of screw threads or toggles or the like capable of exerting a mechanical advantage to form tight cooperating sealing surfaces which withstand the passage of gases or liquids between the container body and the cap for the container.

In one type of prior art container of this class, the cooperating sealing surfaces are parallel or substantially parallel with relatively wide matching surfaces when engaged.

Such types of prior art containers have several disadvantages, such as for example: (1) the caps are not easily removable and replaceable but instead require time-consuming care such as cleaning or the like to provide a proper seal the second time they are used; (2) they are subject to fouling by solid debris such as particles within the material being contained; (3) some of them are not stable to corrosive materials and solvents; and (4) they do not consistently and quickly form a gas-tight seal so as to maintain a vacuum or hold gas under positive pressure or preserve an inert atmosphere within them.

SUMMARY OF THE INVENTION

Accordingly, it is an object of the invention to provide a novel container.

It is a further object of the invention to provide a novel technique for sealing containers containing corrosive materials.

It is a still further object of the invention to provide a novel cap for a container which is easily replaceable without special care, resistant to corrosive atmospheres and able to form a gas-tight seal.

In accordance with the above and further objects of the invention, a container and a cap for the container have cooperating sealing surfaces which meet at an angle substantially perpendicular to each other. The cooperating sealing surfaces have a relatively narrow portion meeting a flat portion and is applied with substantial force through a mechanism that provides mechanical advantage as the cap and container are fastened to each other.

Generally, the contact area between the cooperating sealing surfaces is continuous, forming a closed line having a width of between 0.5 to 1.5 millimeters at an angle to the direction of closing and with the cooperating surfaces meeting with each other at an angle of between 75 degrees and 105 degrees. The angle should be as close to 90 degrees as possible to form a narrow circumferential closing point contact with as much pressure as practical. The meeting surfaces should not be brittle but should have a high modulus of elasticity and a high yield point. The yield point must be greater than 100 psi (pounds per square inch) in compression and the modulus of elasticity should be in the range of two million to 30 million psi. A stop should be provided that terminates the pressure and the motion of the cooperating sealing surfaces toward each other at the proper pressure.

In one embodiment, the cap is threaded onto the neck of the container to provide a mechanical advantage. The cooperating sealing surface on the container is at an angle to the central axis of the container and of the cap and the cap includes a downwardly extending wall terminating in an edge that engages the cooperating sealing surface of the container. The stop is provided by engaging surfaces on the top of the neck of the container which engages a surface on the cap. The container may be made of materials that withstand acidic and caustic environments such as stainless steel and TEFLON (trademark of DuPont de Nemours, E. I., Co., Wilmington, Del. 19898 for tetrafluoroethylene fluorocarbon polymers) or combinations of the two.

From the above description, it can be understood that the container and lid of this invention have several advantages, such as for example: (1) the cap is easily removable and replaceable without special time-consuming procedures such as the cleaning of portions that are to remate with each other during resealing; (2) it avoids fouling by solid debris such as small particles or the like without exceptional preparations; (3) it withstands the deteriorating effects of corrosive materials and solvents; and (4) it can consistently and quickly form a gas-tight seal.

SUMMARY OF THE DRAWINGS

The above-noted and other features of the invention will be better understood from the following detailed description when considered with reference to the accompanying drawings, in which.

DETAILED DESCRIPTION

Figure 1:
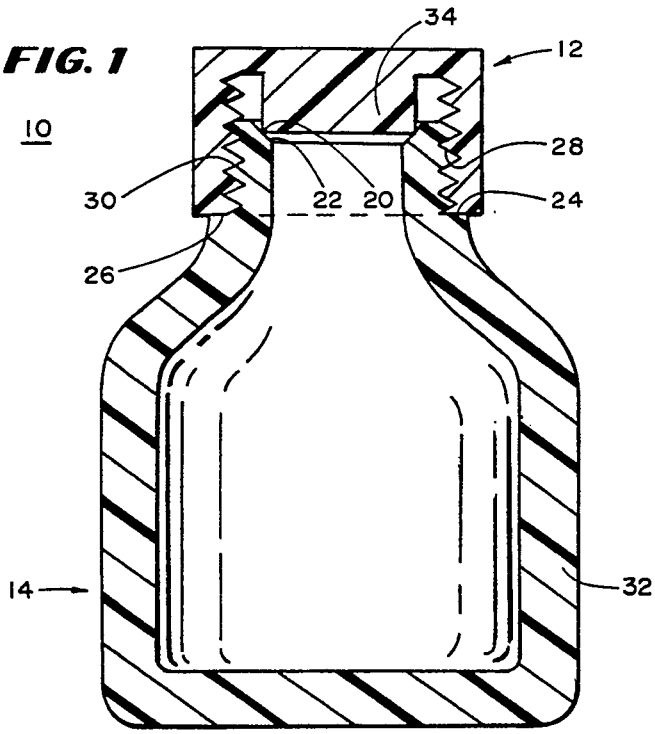
FIG. 1 is a sectional view of a container and cap in accordance with an embodiment of the invention.

In FIG. 1, there is shown a sectional view of a container and a cap 10 including a receptical 14 and a cap 12 threaded together to form a seal against a corrosive environment. It is intended for uses such as the storage and/or use of highly reactive corrosive materials, temporary storage and transport of corrosive/toxic samples from larger reaction vessels, rapid storage of air-sensitive or corrosive substances in the presence of sand or other small particles or abrasives that could interfere with gas-tight seals or as a reaction vessel in which reactions take place.

For these purposes, the receptical 14 includes continuous walls 32 forming a solid receptical with an open top, a cooperating sealing surface 22 for a seal, a stop surface 24 cooperating with the cap 12 to stop downward movement of the cap 12 and a mechanical advantage surface in the form of external threads 30 which cooperate with the cap 12 to provide force downwardly to hold the two together to form an enclosure.

The cap 12 similarly includes a matching cooperating sealing surface 20, matching stop surface 26 and a cooperating mechanical advantage means in the form of internal threads 28. The matching cooperating sealing surface 20 is provided at the edge of a downwardly extending cylinder 34, which edge contacts the flat cooperating sealing surface 22 on the bottle in a ring that entirely encircles the opening within the receptical 14 and blocks it with the surface of the cylinder 34.

With this arrangement, the cooperating sealing surface 20 is perpendicular to the cooperating sealing surface 22 and exerts a very intense narrow closure with a contact within the range of 0.5 to 1.5 millimeters wide. In the preferred embodiment, that contact is perpendicular but should fall within a range of 75 degrees to 105 degrees to the flat cooperating sealing surface 22 or the supplements of those angles. Generally, at least one of the cooperating sealing surfaces 20 or 22 must be sufficiently deformable to form a seal, and both cooperating sealing surfaces 20 and 22 cannot be so brittle or hard as to leave crevices when impacted with full force. The two cooperating sealing surfaces 20 and 22 move toward each other during closing of the receptical 14 in a direction aligned with the longitudinal axis of at least a portion of the container but one of the cooperating sealing surfaces is flat and is at an angle to the direction of motion and the other is an edge so as to insure meeting of the cooperating sealing surfaces without requiring great precision in their alignment. The flat surface is at least 5 times wider than the edge.

The pressure between the two cooperating sealing surfaces 20 and 22 together should be at least 100 psi when the stop surfaces 24 and 26 are engaged to prevent further threading of the cap 12 downwardly on the neck of the bottle. The threads of the bottle must provide a mechanical advantage of at least one and one-half to one but generally is much greater than that. For each one and one-half inches of rotary motion of the cap 12, the cooperating sealing surfaces 20 and 22 should move together no more than one inch so that less force is required to turn the cap 12 than is actually applied at the contacting circle. To provide the deformability, the yield point of the cooperating sealing surface 20 is greater than 100 psi and the modulus of elasticity is in the range of two million to 30 million psi.

Figure 2:
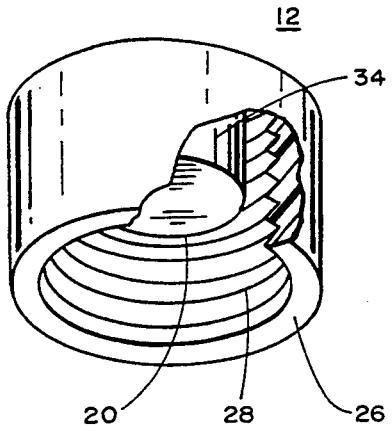
FIG. 2 is a perspective view, partly broken away, of the cap of FIG. 1.

In FIG. 2, there is shown a perspective view of the cap 12 partly broken away to show the internal threads 28 and the bottom edge 20 of the downwardly extending cylinder 34. The bottom surface of that cylinder 34 closes the receptical wall 32 (FIG. 1) and the edge 20 bears against the cooperating sealing surface 22 (FIG. 1) to ensure a tight seal. In the embodiment of FIG. 2, the downwardly extending cylinder 34 is integrally formed within the cap 12 but may be threaded into place as shown hereinafter, provided that the joining threads or other fasteners that hold a replaceable member in place within the cap 12 are on the outside of the sealing surface of the downwardly extending cylinder such as 34 in FIG. 2.

Figure 3:
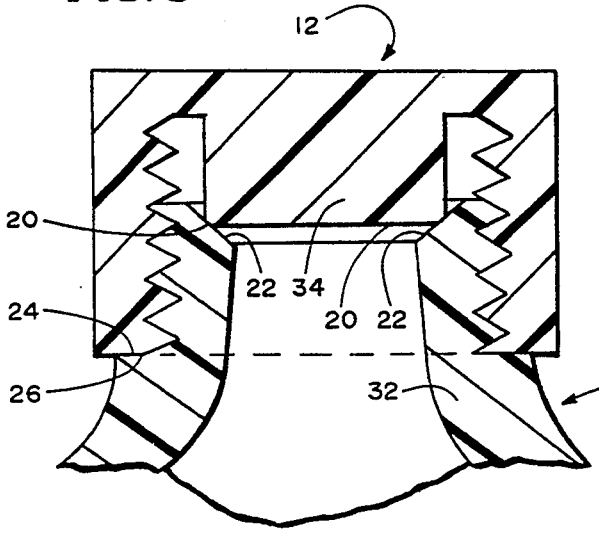
FIG. 3 is an enlarged fragmentary sectional view of a portion of the embodiment of FIG. 1.

In FIG. 3, there is shown a fragmentary sectional view partly broken away of the neck of the receptical 14 and cap 12 enlarged to show more clearly the cooperating sealing surfaces 20 and 22. As shown in this view, the circular edge 20 of the downwardly extending solid cylinder 34 that forms a part of the lid 12 engages the angled surface 22 and is perpendicular to it. When the words perpendicular edge are used to describe this embodiment, the specification means that the central conical plane that bisects the bottom surface plane and the side wall of the cylinder 34 is perpendicular to the surface 22. Because the cylinder is a right regular cylinder, the bottom plane and side walls of the cylinder each make a 45-degree angle with the surface 22. Pressure is applied by the threads which are internal on the lid 12 and external to the neck of the bottle 14.

To prevent a wider contacting flattened surface at the contact points between 20 and 22 caused by over-tightening and to prevent the application of a force so large as to exceed the yield point of the material from which the lid 12 is made, the cooperating stop surfaces 24 and 26 are formed on the lid 12 and the receptical wall 32 respectively. When the surfaces engage, the lid 12 can no longer be threaded further down but the cooperating surfaces 20 and 22 are fully engaged to form a tight seal.

Figure 4:
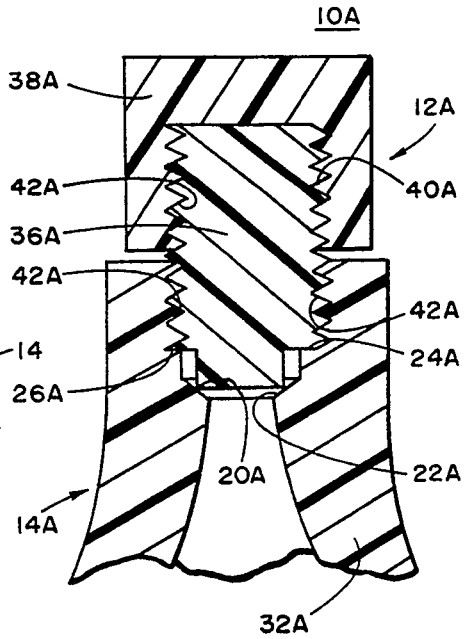
FIG. 4 is a fragmentary sectional view of another embodiment of the invention.

In FIG. 4, there is shown a fragmentary sectional view of another embodiment of container and cap 10A having a cap 12A and a receptical 14A. In this embodiment, the cap 12A is formed as two threaded members 36A and 38A. The threaded member 36A has external threads which engage: (1) with the internal threads of the walls 32A of the receptical 14A to form a closure; and (2) with the internal threads of the body portion 38A to permit threading thereinto.

More specifically, a downwardly extending externally-threaded insert 36A forming a part of the cap 12A is threadably fastened by external threads 40A on its upper portion into a recess having internal threads 42A of the body portion 38A of the cap 12A to be engaged therein. The insert 36A is of a smaller diameter than the body portion 38A and includes at its lower end the circular cooperating sealing surface 20A which cooperates and is perpendicular to an angled cooperating sealing surface 22A on the receptical 14A to form a circular seal closed by its circular bottom surface. This member 36A seals in a manner similar to that of the cylinder 34 in the embodiment of FIGS. 1–3 but is removable from the main body portion 38A of the cap 12A.

Figure 5:
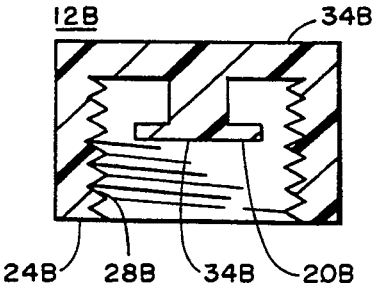
FIG. 5 is a sectional view of another embodiment of cap usable in accordance with the invention.
Figure 6:
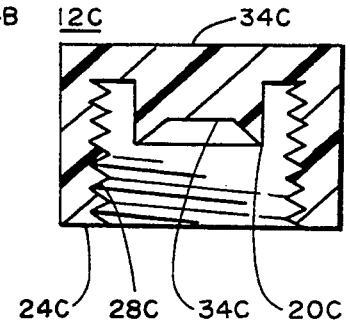
FIG. 6 is a sectional view of still another embodiment of cap usable in accordance with the invention.
Figure 7:
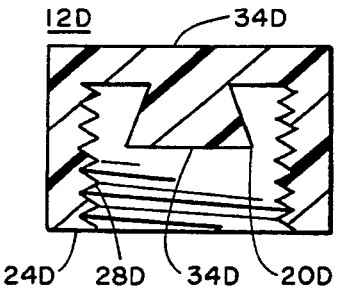
FIG. 7 is a sectional view of still another embodiment of cap usable in accordance with the invention.

In FIGS. 5, 6 and 7 there are shown sectional views of three other embodiments of caps or lids 12B, 12C and 12D respectively in accordance with the invention. Each of these are adapted to cooperate with the walls 32 (FIG. 1) of a receptical 14 in a manner similar to the embodiment of FIG. 1, and for that purpose have: (1) internal threads 28B, 28C and 28D respectively which cooperate in the same manner as the threads 28 (FIG. 1) with corresponding threads in the walls 32 of a receptical 14 to provide a mechanical advantage; (2) annular stop surfaces 24B, 24C and 24D respectively to cooperate with stop surfaces 26 (FIG. 1); and (3) downwardly extending members 34B, 34C and 34D having circular bottom areas surrounded by the circular cooperating sealing surfaces 20B, 20C and 20D respectively to form a seal with cooperating sealing surface 22 (FIG. 1) in the container 32.

However, in the embodiment of FIG. 5, the downwardly extending member 34B is a cylinder of narrower diameter with a larger diameter disk centered at its end forming the sealing edge 20B. In the embodiment of 12C, the surface 20C forms a sharper angle and is the edge of a downwardly-extending cylindrical side wall with the bottom of the cylinder slanting inwardly and upwardly to a narrower diameter circular portion so that it forms an opening that extends upwardly as a truncated cone in the center of a downwardly extending cylinder to provide a larger space within the seal and a sharper perpendicular higher intensity member against the cooperating sealing surface 22 (FIG. 1). The embodiment 12D has a member 34D that is not formed as a cylinder but instead as a truncated cone and thus has a larger open area above the seal and is more flexible than some embodiments in cooperating with the cooperating sealing surface 22 (FIG. 1). All of these three embodiments provide greater conforming flexibility so as to more easily conform to the circular cooperating sealing surface 22 (FIG. 1) than the embodiment of FIG. 1.

Figure 8:
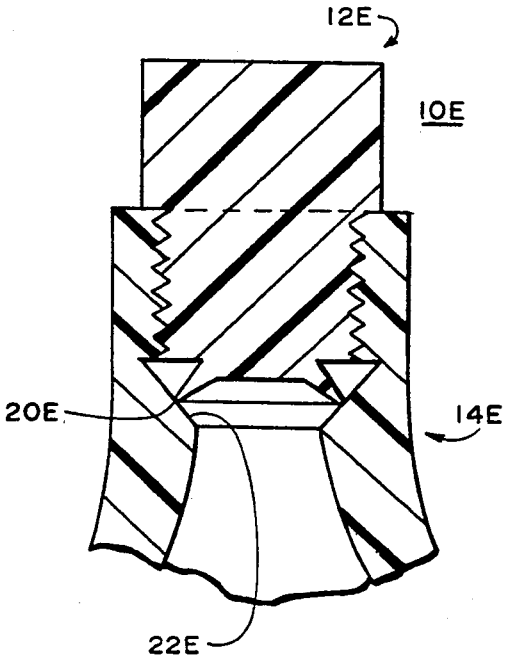
FIG. 8 is a fragmentary sectional view of still another embodiment of the invention.

In FIG. 8, there is shown a fragmentary sectional view of still another embodiment of container and cap 10E having a cap 12E and receptical 14E. This embodiment most closely resembles the embodiment 10A of FIG. 4 except that it does not have a removable insert and its bottom portion includes outwardly extending portions which are at an acute angle of approximately 30 degrees with the central longitudinal axis of the cylindrical cap 12E. The bottom of the threaded portion reaches a stop before the angled cooperating surface 22E which is at an obtuse angle to the longitudinal axis of the cap 12E of 60 degrees so that the cooperating sealing surface 20E of the cap 12E and the cooperating sealing surface 22E are substantially perpendicular to each other.

Figure 9:
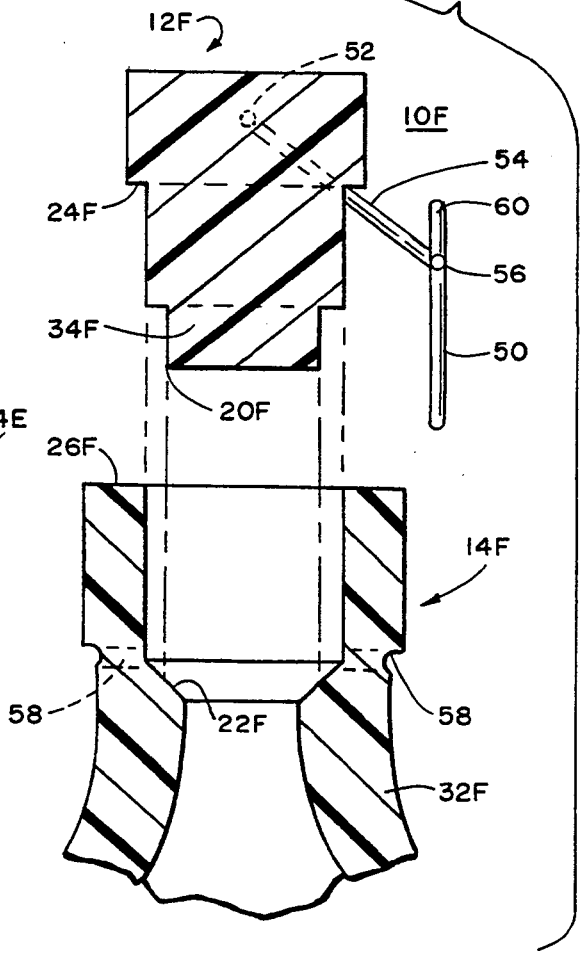
FIG. 9 is a fragmentary sectional view of still another embodiment of the invention.

In FIG. 9, there is shown still another embodiment 10F similar to the embodiments of FIG. 4 and FIG. 8 having stop surfaces 24F and 26F, cooperating sealing surfaces 20F and 22F, and a downwardly extending cylinder 34F. These parts operate in a manner similar to the corresponding parts in the embodiments of FIG. 4 and FIG. 8 except that the cylinder 34F is not removable from the cap body and the mechanical advantage is not provided by threads.

Instead of the mechanical advantage being provided by a screw mechanism, the cap 12F is tightly insertable into the walls 32F of the receptical 14F and locked in place by a toggle mechanism pivotably pinned at diametrically opposite points 52 in the rim of the cap 12F and having a lever yoke 54 extending from the pivot points on the cap, one such point 52 being shown in FIG. 9. The yoke 52 includes at its distal points a second pivot poing 56 for a pivotally joined lever mechanism 50.

To provide locking leverage, an upstanding ear 60 is mounted to the lever mechanism 50 and fits within a detent opening 58 that annularly extends around the outer periphery of the wall 32F. The ear 60 is located to contact the underside of the detent 58 when the cap 12F is fully inserted into the walls 32F in a sealing arrangement and the lever mechanism 50 is raised and is cammed into the detent 58 when the lever mechanism is lowered. For it to fit thereunder, the lever mechanism 50 must be in an upwardly extending position so that the ear 60 which extends beyond the pivot point 56 opposite to the lever mechanism 50 is downward forming a flush surface under the detent 58. When the lever mechanism 50 is pulled downwardly, the ear 60 moves upwardly and locks within the detent 58 until released, applying sealing pressure between the cooperating circular surfaces 20F and 22F.

In each of the above embodiments, corrosive, basic or acidic members can be inserted in an inner container having a cap member and receptical portion made of glass, inert plastic such as TEFLON (trademark for tetrafluoroethylene fluorocarbon polymers) or stainless steel or the like. The cap portion is inserted with a mechanical advantage to create strong downward pressure. The mechanical advantage can be screw threads or levers or any other mechanical advantage device provided it provides a advantage of at least 1.5 (movement in closing the cap is 1.5 linear units of length greater than the movement in the direction of application of the force of the sealing surfaces).

When the cap moves downwardly, stop surfaces engage to prevent further downward movement at an appropriate pressure. At this point, cooperating sealing surfaces on the cap and the receptical form a closed sealing line such as a circle with a width of 0.5 to 1.5 millimeters at an angle between the cooperating sealing surfaces of between 75 degrees and 105 degrees. These surfaces cannot be brittle and must have a yield point greater than 100 psi and a modulus of elasticity in the range of two million to 30 million psi.

After storage or completion of a reaction in the container, the cap may be removed in the same manner as fastened using the mechanical advantage of a lever or screw threads to remove it. The contents can then be removed and the container cleaned easily or used without cleaning if the nature of the two contents permit. The cap and fastener can be easily cleaned and reinserted even though the contents of the container or environment may include particles and may be corrosive.

In one embodiment, to provide longer life, an angled surface on the receptical is formed of a material with a harder surface than the cooperating sealing surface on the cap, but the cooperating surface on the cap is part of a removable and replaceable insert in the cap. It may be fastened to the cap by internal threads or other fastening means above the cooperating sealing surfaces and the flat area enclosed by the cap's sealing surfaces so that it does not permit the passage of gas thereinbetween.

From the above description, it can be understood that the container and lid of this invention have several advantages, such as for example: (1) the cap is easily removable and replaceable without special time-consuming procedures such as the careful cleaning of portions of cooperating sealing surfaces before the cap can be resealed to the container; (2) it avoids fouling by solid debris such as small particles or the like in the contents of the container without exceptional preparations; (3) it withstands the deteriorating effects of corrosive materials and solvents; and (4) it can consistently and quickly form a gas-tight seal.

Although a preferred embodiment of the invention has been described at some detail, many combinations and variations of the invention are possible within the light of the above teachings. Therefore, it is to be understood, within the scope of the appended claims, the invention may be practiced other than as specifically described.

What is claimed is:

1. The combination of a container and a cap comprising:

a container having a solid wall with wall portions defining an opening wherein an enclosure is defined capable of containing fluids;

a cap adapted to close said opening;

said container having a first surface and a second surface and said cap having a third surface, a fourth surface, and a fifth surface;

said third surface and said fifth surface defining a circular edge;

said first surface cooperating with said third surface and said fifth surface wherein said first surface and said circular edge engage each other in a closed line when said cap is fully inserted;

said second surface and said fourth surface engaging each other to form a stop against further movement of said cap and container toward each other;

said circular edge being part of a solid cylinder integrally connected to and extending downwardly from said cap and said first surface being flat and positioned to engage said circular edge of said part of said solid cylinder, wherein the closed line has a width perpendicular to its length within a range of 0.5 millimeters to 1.5 millimeters; and means for forcing said cooperating surfaces together with a pressure of at least 100 psi;

said first and third cooperating surfaces meeting at a first angle of between 75 degrees and 105 degrees and said first and fifth surfaces meeting at a second angle of between 75 degrees and 105 degrees.

2. A combination in accordance with claim 1 in which a yield point of the materials forming the cooperating surfaces is at least as high as 100 psi.

3. A combination in accordance with claim 1 in which at least one of said first surface and said circular edge has a modulus of elasticity of between two million to 30 million psi.

4. A combination in accordance with claim 1 in which one of the cooperating surfaces is said circular edge and the other is said flat surface which is at least 5 times wider than the edge.

5. A combination in accordance with claim 4 in which there is a path of motion between the cap and the container in closing and opening the container towards and away from each other and the flat surface is at an angle to the direction of motion of the cap and the container.

* * * * *